US009909776B2

(12) United States Patent
Okamoto

(10) Patent No.: US 9,909,776 B2
(45) Date of Patent: Mar. 6, 2018

(54) AIR CONDITIONER

(71) Applicant: Mitsubishi Electric Corporation, Tokyo (JP)

(72) Inventor: Akira Okamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 356 days.

(21) Appl. No.: 14/700,318

(22) Filed: Apr. 30, 2015

(65) Prior Publication Data

US 2015/0345820 A1 Dec. 3, 2015

(30) Foreign Application Priority Data

May 27, 2014 (JP) ..... 2014-109217

(51) Int. Cl.
*F24F 11/00* (2006.01)

(52) U.S. Cl.
CPC ..... *F24F 11/0086* (2013.01); *F24F 11/0009* (2013.01); *F24F 2011/0045* (2013.01);
(Continued)

(58) Field of Classification Search
CPC ..... F24F 11/0086; F24F 11/009; F24F 2011/0068; F24F 2011/0052; F24F 2011/0045
(Continued)

(56) References Cited

U.S. PATENT DOCUMENTS 5,647,223 A * 7/1997 Wada ..... F24F 11/0009 165/209
2004/0111186 A1* 6/2004 Rossi ..... G05B 23/0235 700/276
(Continued)

FOREIGN PATENT DOCUMENTS

JP 07-103540 A 4/1995
JP 10-318591 A 12/1998
(Continued)

OTHER PUBLICATIONS

Office Action dated Jul. 28, 2017 issued in corresponding CN application No. 201510259227.2 (and partial English translation).
(Continued)

*Primary Examiner* — Mohammad M Ali
(74) *Attorney, Agent, or Firm* — Posz Law Group, PLC

(57) ABSTRACT

An air conditioner includes an indoor device that is controlled by a remote controller and an outdoor device that is connected to the indoor device. The outdoor device is configured to include an outdoor-device state-quantity acquisition unit (a compressor-data acquisition unit and a heat-exchanger-data acquisition unit) that acquires an outdoor-device state quantity indicating a state quantity, acquired during maintenance and during a test run, of a component included in the outdoor device. The indoor device is configured to include an indoor-device state-quantity acquisition unit (a heat-exchanger-data acquisition unit) that acquires an indoor-device state quantity indicating a state quantity, acquired during maintenance and during a test run, of a component included in the indoor device, and a storage unit that stores therein the outdoor-device state quantity and the indoor-device state quantity.

6 Claims, 3 Drawing Sheets

(52) U.S. Cl.
CPC ..... *F24F 2011/0052* (2013.01); *F24F 2011/0068* (2013.01)

(58) Field of Classification Search
USPC ..... 62/175
See application file for complete search history.

(56) References Cited

U.S. PATENT DOCUMENTS

2011/0275364 A1* 11/2011 Austin ..... H04L 41/12 455/423
2012/0053738 A1* 3/2012 Lingrey ..... F24F 11/0012 700/278

FOREIGN PATENT DOCUMENTS

| | | | |
|---|---|---|---|
| JP | 2001-208403 | A | 8/2001 |
| JP | 2003-42520 | A | 2/2003 |
| JP | 2007-285668 | A | 11/2007 |
| JP | 2009-144960 | A | 7/2009 |
| JP | 2009-275943 | A | 11/2009 |

OTHER PUBLICATIONS

Office Action dated Jul. 4, 2017 issued in corresponding JP application No. 2014-109217 (and English translation).

* cited by examiner

AIR CONDITIONER

BACKGROUND OF THE INVENTION

1. Field of the Invention

The present invention relates to an air conditioner.

2. Description of the Related Art

When a conventional air conditioner is undergoing maintenance and being tested, operation data is displayed on a wired remote controller that is connected to an indoor device through a communication line. The data that is displayed includes date such as current consumption by the compressor, the total operating time, the number of operations, the operating frequency of the air conditioner, discharge temperature of the outdoor device, temperature of a heat exchanger, and the outside air temperature.

Japanese Patent Application Laid-open No. 2009-144960, for example, discloses a remote controller for an air conditioner designed for "conducting a smooth analysis when there is a system abnormality or the like by accurately acquiring historical information in chronological order even when the clock time has previously been corrected". In the remote controller, "even when the clock-time correcting unit 5 has corrected the clock time before the present time, a history after the clock-time correction is stored in the storage unit 7 as separate control history data according to an instruction from the information management unit 6, and the control history data is assigned with a serial number that follows the serial number of the control history data stored before the clock-time correction so that history information can be acquired in the order of changes in the actual state with reference to the serial number assigned to the control history data regardless of the time and date information, and thus it is possible to conduct a smooth analysis when there is a system abnormality or the like". In the case of the air conditioner disclosed in Japanese Patent Application Laid-open No. 2009-144960, the control history data is stored in the remote controller.

However, with the conventional technique described above, operation data acquired during a previous maintenance period and test run is stored in the remote controller; therefore, if the remote controller in which the operation data is stored stops working, the stored previous operation data is lost and if the remote controller in which the operation data is stored is replaced by another (new) remote controller, reference cannot be made to the accumulated previous data. Therefore, the conventional technique has a problem whereby, depending on the state of the remote controller, there is a failure to conduct a smooth analysis when a system abnormality or the like occurs.

SUMMARY OF THE INVENTION

It is an object of the present invention to at least partially solve the problems with the conventional technology.

The present invention relates to an air conditioner that includes: an indoor device that is controlled by a remote controller; and an outdoor device that is connected to the indoor device. The outdoor device includes an outdoor-device state-quantity acquisition unit that acquires an outdoor-device state quantity indicating a state quantity of a component included in the outdoor device, the state quantity being acquired during maintenance and during a test run. The indoor device includes an indoor-device state-quantity acquisition unit that acquires an indoor-device state quantity indicating a state quantity of a component included in the indoor device, the state quantity being acquired during the maintenance and during the test run, and a storage unit that stores therein the outdoor-device state quantity and the indoor-device state quantity.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an air conditioner according to the present invention will be described below in detail with reference to the accompanying drawings. The present invention is not limited to the embodiments.

First Embodiment

Figure 1:
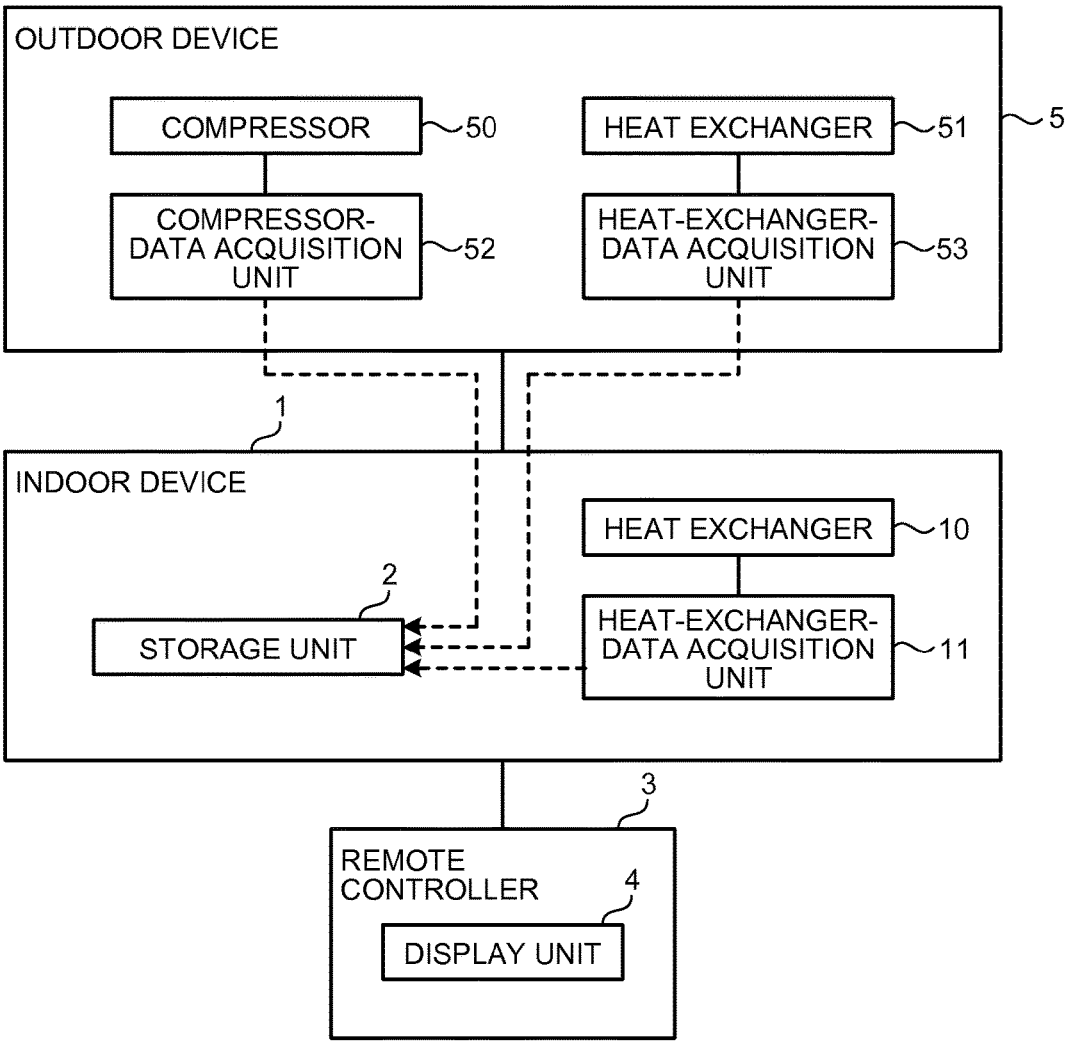
FIG. 1 is a block diagram illustrating a configuration of an air conditioner according to a first embodiment of the present invention.

FIG. 1 is a block diagram illustrating a configuration of an air conditioner according to a first embodiment of the present invention. The air conditioner illustrated in FIG. 1 includes an indoor device 1 including a storage unit 2; a remote controller 3 having a display unit 4; and an outdoor device 5 that is connected to the indoor device 1.

The storage unit 2 includes a nonvolatile memory. A nonvolatile memory is exemplified by an EEPROM (Electrically Erasable Programmable Read Only Memory), which is easily available. When an EEPROM is used as the nonvolatile memory of the storage unit 2, it is possible to reduce the cost and improve the manufacturing productivity. In the storage unit 2, at least operation data acquired during maintenance and a test run is stored.

Figure 2:
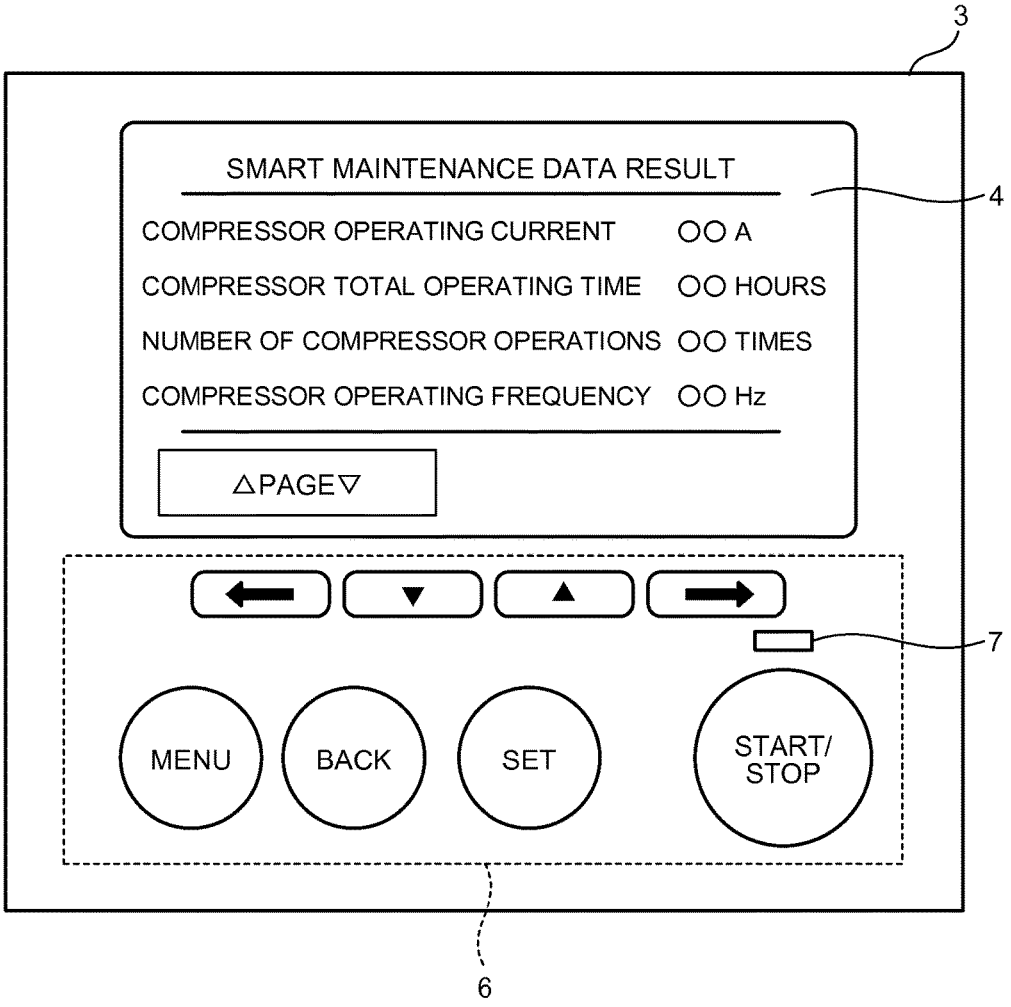
FIG. 2 is a diagram illustrating the appearance of a remote controller for the air conditioner according to the first embodiment.

FIG. 2 is a diagram illustrating an example of an appearance of the remote controller 3 of the air conditioner according to the first embodiment. The remote controller 3 illustrated in FIG. 2 has the display unit 4, operation buttons 6, and a lamp 7. The operation buttons 6 of the remote controller 3 exemplified in FIG. 2 include a "START/STOP" button for controlling the starting and stopping of an operation of the air conditioner; a "MENU" button for displaying a menu screen; buttons for shifting a selected part upward, downward, rightward, and leftward on a select-function screen displayed on the display unit 4; a "SET" button for setting a function selected on the select-function screen; and a "BACK" button for turning back to the last screen on the select-function screen. While checking the content displayed on the display unit 4, a user operates the operation buttons 6 to control the operation of the indoor device 1. The lamp 7 is used to indicate the operating state or the like of the air conditioner. The lamp 7 lights up or flashes according to the operating state of the air conditioner.

The indoor device 1 includes a heat exchanger 10. A heat-exchanger-data acquisition unit 11 is connected to the heat exchanger 10. The heat-exchanger-data acquisition unit 11 includes a temperature sensor or the like and acquires the temperature or the like of the heat exchanger 10. The outdoor device 5 includes a compressor 50 and a heat exchanger 51. A compressor-data acquisition unit 52 is connected to the compressor 50. A heat-exchanger-data acquisition unit 53 is connected to the heat exchanger 51. The compressor-data acquisition unit 52 includes a current sensor, a timer, and the like, and acquires an operating current (current consumption), the total operating time and the like of the compressor 50. The heat-exchanger-data acquisition unit 53 includes a temperature sensor or the like and acquires a temperature or the like of the heat exchanger 51.

An operation of the air conditioner according to the first embodiment is described next. First, a user turns on the indoor device 1 and the outdoor device 5 and sets the "maintenance and test run" operation mode with the remote controller 3. In the "maintenance and test run" operation mode, the heat-exchanger-data acquisition unit 11 acquires the temperature or the like of the heat exchanger 10 provided in the indoor device 1; the heat-exchanger-data acquisition unit 53 acquires the temperature or the like of the heat exchanger 51 provided in the outdoor device 5; and the compressor-data acquisition unit 52 acquires current consumption or the like of the compressor 50 provided in the outdoor device 5. Data acquired by the heat-exchanger-data acquisition units 11 and 53 and the compressor-data acquisition unit 52 is stored in the storage unit 2 of the indoor device 1. After the end of the "maintenance and test run" operation mode, the operation mode is switched to a normal operation mode. In this manner, data, which includes the temperatures of the heat exchangers, the current consumption by the compressor, and the like in the "maintenance and test run" operation mode, is stored in the storage unit 2.

Thereafter, the air conditioner is operated in the normal operation mode. If a system abnormality or the like occurs in the normal operation mode, reference can be made to the data acquired in the previous "maintenance and test run" operation mode and stored in the storage unit 2. In the present invention, because the air conditioner is configured as illustrated in FIG. 1 so that the data acquired in the "maintenance and test run" operation mode is stored in the storage unit 2 of the indoor device 1 instead of in the remote controller 3, the data acquired in the "maintenance and test run" operation mode is not lost even if the remote controller 3 stops working; and the data can be read from the storage unit 2 of the indoor device 1 even if the remote controller 3 is replaced by another (new) remote controller. By storing the data acquired in the "maintenance and test run" operation mode in the storage unit 2 of the indoor device 1 in this manner, the accumulated previous data is referred to so that current data is compared thereto even when the remote controller has stopped working or even after the remote controller is replaced. This facilitates identification of an abnormal part, thereby enabling a smooth analysis of the abnormalities (malfunctions).

Temperature information on the heat exchanger included in the indoor device, temperature information on the heat exchanger included in the outdoor device, and current consumption of the compressor included in the outdoor device are described in the first embodiment as examples of the data to be stored in the storage unit of the indoor device. However, the present invention is not limited to these examples. It is adequate if data to be stored in the storage unit of the indoor device is a state quantity of the air conditioner, and an example thereof can be the temperature of the refrigerant or outside air or the operating frequency of the compressor.

The air conditioner can be configured such that, when an error occurs during maintenance and a test run, the display unit 4 or the lamp 7 of the remote controller 3 flashes so as to notify the user of the error.

Because it is possible to easily conduct an analysis of abnormalities (malfunctions) of the air conditioner as described in the first embodiment, the repair or replacement of a component can be efficiently and satisfactorily performed, with the result that the operating life of the air conditioner can be extended.

Second Embodiment

Figure 3:
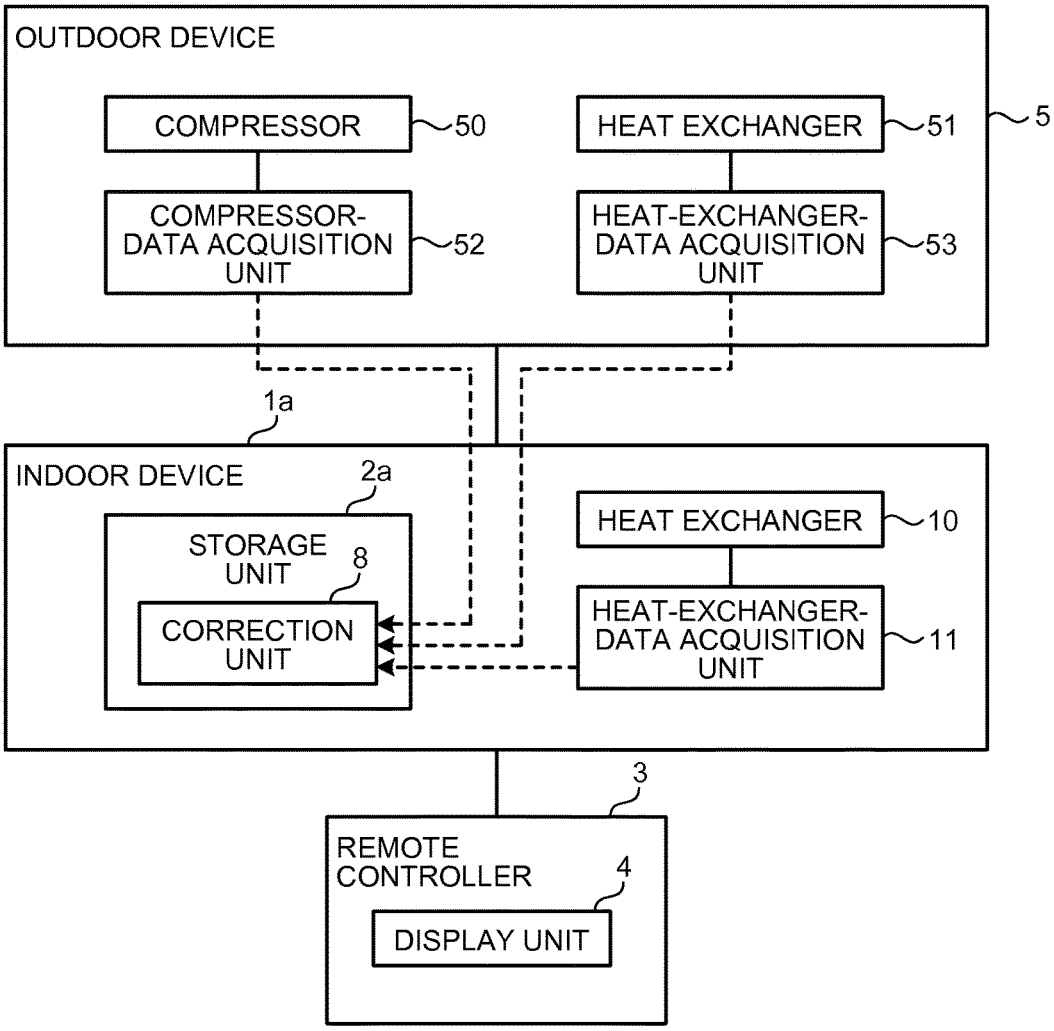
FIG. 3 is a block diagram illustrating a configuration of an air conditioner according to a second embodiment of the present invention.

FIG. 3 is a block diagram illustrating a configuration of an air conditioner according to a second embodiment of the present invention. The air conditioner illustrated in FIG. 3 has a configuration identical to that of the air conditioner illustrated in FIG. 1 according to the first embodiment, except that the storage unit includes a correction unit.

A correction unit 8 obtains information on the free space in a storage unit 2*a*, and when data is accumulated in the storage unit 2*a*, creates a space in the storage unit 2*a*. When data to be stored in the storage unit 2*a* is being generated, the correction unit 8 checks the free space when the newly generated data is being stored. When the free space is less than or equal to a preset threshold, the correction unit 8 performs processing on stored data to create an area in the storage unit 2*a* for storing the new data therein.

An example of the processing that is performed on the stored data to create an area in the storage unit 2*a* for storing new data therein is described below. It is assumed that all the data to be processed is provided with time information. On the basis of the time information provided to the data to be processed, a data value (such as 50° C., which is a temperature of the heat exchanger 10 of an indoor device 1*a*) of the oldest data (initial data) among the data to be processed is set as a data reference value. The data to be processed which is accumulated in the storage unit 2*a* is then compared to the data reference value, and only a data value (such as 55° C., which is a temperature of the heat exchanger 10 of the indoor device 1*a*) that exceeds the data reference value is left, while other data is discarded to create a storage area.

Data that is generated in subsequent operations and is to be stored in the storage unit 2*a* is compared to the data reference value when the generated data is being stored, and only a data value that exceeds the data reference value is stored.

The second embodiment has described a configuration in which a data value that exceeds the data reference value is stored. However, note that the present invention is not limited to this configuration. It is also possible to employ a configuration in which a data value that exceeds the reference data value is discarded while a data value that is less than or equal to the data reference value is stored.

As a result of performing processing on data in the storage unit 2*a* as described in the second embodiment, only an abnormal data value remains, which is associated with the time information. Therefore, it is possible to accumulate previous data for conducting a smooth analysis during a system abnormality or the like while still efficiently using the storage unit 2*a*.

In the first and second embodiments, when operation data stored in the storage unit is displayed on the display unit of the remote controller, the operation data can be provided in descending order of the difference between the operation data and a reference value. An example of the reference value can be the data reference value described in the second embodiment.

The first and second embodiments have described a configuration in which only the indoor device includes a storage unit. However, the present invention is not limited to this configuration. The remote controller can also include a storage unit. In this case, the storage unit included in the remote controller can store therein the same content as that stored in the storage unit included in the indoor device. With this configuration, previous operation data is not lost even if a malfunction occurs in the indoor device, and thus it is possible to provide an air conditioner that is capable of accumulating previous data for conducting a smooth analysis during a system abnormality or the like, without operation data acquired during maintenance and a test run being lost even if either the indoor device or the remote controller has stopped working. When the storage unit included in the remote controller and the storage unit included in the indoor device store therein the same content, it is possible to apply a setting in which the content stored in one of the storage units is overwritten upon overwriting of the content stored in the other storage unit or in which the content stored in the storage units is updated regularly (for example, every day).

Furthermore, in a case where the remote controller is shared with another air conditioner (in a case where one remote controller controls a plurality of air conditioners), when the remote controller is configured to also include the storage unit as described above, the storage unit included in the remote controller stores therein the same content as that stored in the storage units included in the indoor devices and can compare operation data in the plurality of air conditioners with each other.

Further, in a case where the remote controller also includes the storage unit and the storage unit included in the remote controller stores the same content as that stored in the storage unit included in the indoor device as described above, when the remote controller is replaced by another (new) remote controller, it is preferable, for example, that previous data is read out of the storage unit included in the indoor device and stored in a storage unit included in this other (new) remote controller during the initial setting. With this configuration, even after replacement of the remote controller, data accumulated before the replacement can be stored in both the storage unit in the indoor device and the storage unit in the remote controller, and thus it is possible to prevent previous data from being lost.

According to the present invention, it is possible to provide an air conditioner that is capable of accumulating previous data for conducting a smooth analysis during a system abnormality or the like, without operation data acquired during maintenance and a test run being lost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An air conditioner comprising:

an indoor device that is controlled by a remote controller; and an outdoor device that is connected to the indoor device, wherein the outdoor device includes an outdoor-device component state-quantity acquisition unit that acquires an outdoor-device component state quantity indicating a state quantity of a component included in the outdoor device, the outdoor-device component state quantity being acquired during maintenance and during a test run, and the indoor device includes an indoor-device component state-quantity acquisition unit that acquires an indoor-device component state quantity indicating a state quantity of a component included in the indoor device, the indoor-device component state quantity being acquired during the maintenance and during the test run, and a storage unit that stores therein the outdoor-device state quantity and the indoor-device state quantity.

2. The air conditioner according to claim 1, wherein the outdoor-device component state quantity includes a temperature of a heat exchanger in the outdoor device.

3. The air conditioner according to claim 1, wherein the outdoor-device component state quantity includes information on a compressor in the outdoor device.

4. The air conditioner according to claim 1, wherein the indoor-device component state quantity includes information on a heat exchanger in the indoor device.

5. The air conditioner according to claim 1, wherein the storage unit includes a correction unit, when a free space in the storage unit is less than or equal to a preset threshold during storage of new storage-target data in the storage unit, the correction unit deletes, from data stored in the storage unit, data having a value less than or equal to a reference data value to create a free area in the storage unit and stores the new storage-target data in the created area, where the reference data value is a value of initial data among the data stored in the storage unit, and when another new storage-target data is generated, the correction unit performs processing to cause only data having a value greater than the reference data value to be stored in the storage unit.

6. The air conditioner according to claim 1, wherein the remote controller includes a remote-controller storage unit, and the remote-controller storage unit stores therein the outdoor-device state quantity and the indoor-device state quantity.

* * * * *